US006041959A

United States Patent [19]

Domanico

[11] Patent Number: 6,041,959

[45] Date of Patent: Mar. 28, 2000

[54] CHEMICAL WASTE COLLECTION AND DISPOSAL APPARATUS

[76] Inventor: Edward J. Domanico, 2809 Oak Park Cir., Davie, Fla. 33328

[21] Appl. No.: 08/784,242

[22] Filed: Jan. 15, 1997

Related U.S. Application Data

[60] Provisional application No. 60/009,950, Jan. 16, 1996.

[51] Int. Cl.[7] ..... B65D 25/00

[52] U.S. Cl. ..... 220/23.83; 220/4.27; 220/571; 137/312

[58] Field of Search ..... 220/23.83, 4.27, 220/571; 137/150, 312; 211/68

[56] References Cited

U.S. PATENT DOCUMENTS

| | | | |
|---|---|---|---|
| 1,700,274 | 1/1929 | Smye | 211/68 |
| 2,726,004 | 12/1955 | McLeod | 220/4.27 X |
| 2,743,075 | 4/1956 | Johnson | 220/481 X |
| 4,641,680 | 2/1987 | Been | 137/312 |
| 4,862,909 | 9/1989 | Kim | 137/150 |
| 5,033,637 | 7/1991 | Webb | 220/571 X |
| 5,562,047 | 10/1996 | Forney et al. | 220/571 X |
| 5,582,310 | 12/1996 | Del Zotto | 220/571 X |
| 5,752,543 | 5/1998 | Groening | 220/571 X |
| 5,752,617 | 5/1998 | Yung | 220/571 |

*Primary Examiner*—Steven Pollard
*Attorney, Agent, or Firm*—Malin, Haley & DiMaggio, P.A.

[57] ABSTRACT

A waste collection and disposal system and apparatus is provided that includes modular collection and storage containers which can be smaller than standard 55 gallon drum containers used to transport chemical waste, but can be combined and transported in standard 55 gallon drums. The system is particularly suited for use on-board ships, including cruise and cargo ships. The system provides for collection of chemical waste streams at the waste generation site. The system provides for collection and storage of varying rates of waste generation. The storage containers used in the system are stored on pallets which are configured to hold one or more containers. The pallets include a storage volume to collect any overflow, spillage or leakage that may occur when filling the storage containers. The pallets can include wheels or other means for movement on a lower portion, and can include a handrail to ease movement of the pallet and provide a handhold for use during filling operations.

11 Claims, 4 Drawing Sheets

CHEMICAL WASTE COLLECTION AND DISPOSAL APPARATUS

This application claims the benefit of U.S. Provisional Application No. 60/009,950, filed Jan. 16, 1996.

BACKGROUND OF THE INVENTION

1. Field of the Invention

This invention relates to an apparatus for storage and disposal of chemical wastes, and more particularly to a modular and portable apparatus for storage and disposal of chemical wastes on-board ships, including cruise and cargo ships.

2. Description of Related Art

When on-board cruise ships, cargo ships, and other ships and vessels, hazardous and chemical waste material must be handled properly to meet specific codes and regulations, and to prevent health and environmental harm. Chemicals that must be properly handled include paint and solvents, dry cleaning solutions, photographic chemicals, and batteries.

Many ship operators are not aware of procedures for safe and code compliant handling of chemical waste, and may not properly handle, store, and transport this waste, often resulting in leakage or spillage with resultant health hazards.

Typically, Department of Transportation (D.O.T.) certified drums, with an internal volume of approximately 55 gallons, are used on-board ships for storage and transport of chemical waste. However, the generation rate of independent chemical waste streams vary and some drums will require replacement more frequently than others. The drums are expensive to use for small amounts of waste as the cost to transport each drum is the same regardless of the volume of waste contained therein.

55 gallon storage drums are large and heavy even when partially filled. During operations, the crew must transfer waste from the point of waste generation to the location of the 55 gallon storage drum. This transfer may result in spillage and loss of some of the hazardous waste product. For example, during filling of the 55 gallon drums with collected waste products, overflow of the storage drum and leakage of the chemical waste can occur. Leakage or spillage is even more likely to occur because it takes place on a moving vessel.

A chemical waste and storage system is needed for use onboard ships that solves the above described problems and is convenient and easy to use.

SUMMARY OF THE INVENTION

The present invention is a modular chemical waste collection and disposal system and apparatus that solves the above described problems. The present invention includes a modular collection and storage container having a top with an opening, a bottom, sides consisting of a semi-circular portion, and a planar portion which together form a generally "D" shaped horizontal cross-section, and an interior hollow storage volume. The collection and storage container includes an edge portion that extends outward along the length of the container, and can extend across the top to provide a lifting point.

The collection and storage container of the present invention can be sized and shaped essentially similar to one-half of a United States Department of Transportation (D.O.T.) certified drum, having an internal volume of approximately 55 gallons, that is typically used for hazardous and chemical waste disposal. A 55 gallon drum of this type will thus hold two collection and storage containers of the present invention when the containers are placed planar portion to planar portion within the 55 gallon drum. The collection and storage containers, when sized to fit two each within a 55 gallon drum, hold approximately 24 gallons, and can be made of a non-corrosive material such as plastic, or metal with a non-corrosive lining.

The collection and storage containers can alternately be sized other than one-half of a 55 gallon drum. For example, collection and storage containers of approximately one-third or one-fourth of a 55 gallon drum can be made, and transported three or four each per 55 gallon drum.

The system further includes a collection and storage container retaining pallet having a base with an internal hollow volume. The pallet is modular and can be configured to hold one or more collection and storage containers. The pallet includes an opening or drain that collects chemical waste from overflow or inadvertent spillage from the collection and storage containers retained thereon. The volume of overflow collected in one embodiment is 48 gallons. The pallet's storage volume can include a drain plug on a lower portion for removal of any overflow chemicals collected therein.

The pallet can include a vertical structure or support extending from the periphery of the top edges of the pallet. The vertical structure can engage the exterior edge portion of each collection and storage container to secure each container to the pallet. The engagement can be accomplished by any suitable means such as grooves in the vertical structure to capture the exterior edge portions of the containers. The collection and storage containers can also include lifting points or lifting eyes on the top to provide for ease of insertion into the engaging portion of the vertical structure on the pallet. The pallets can be configured to hold any number of collection and storage containers, in nearly any orientation by adjustment of the position of the vertical structure and engagement.

The pallet may include a guard rail extending vertically from the perimeter of the pallet and up to a height above the collection and storage containers to keep persons away from the containers and to provide a handhold during filling operations. The pallet can be portable and may include means for rolling, such as wheels, located on a lower portion. The guard rail can thus further aid in moving the pallet.

Accordingly, it is an objective of the present invention to provide for chemical waste collection and storage that is portable and permits the waste to be transferred to a storage container at the location of the waste generation.

It is another objective of the present invention to provide for collection of any inadvertent spillage or leakage from the collection and storage containers.

It is still another objective of the present invention to provide collection and storage of chemical waste in modular containers which can be smaller than 55 gallon drum sized units to accommodate varying rates of waste generation.

It is a further objective of the present invention to provide a chemical waste collection system that is easily transported off ship for waste disposal, and that permits removal of collected waste in 55 gallon drum sized units.

In accordance with these and other objects which will become apparent hereinafter, the instant invention will now be described with particular reference to the accompanying drawings.

DESCRIPTION OF THE PREFERRED EMBODIMENTS

Referring now to the figures, the present invention will be described in detail using two embodiments as examples to present the essence of the invention.

Figure 1:
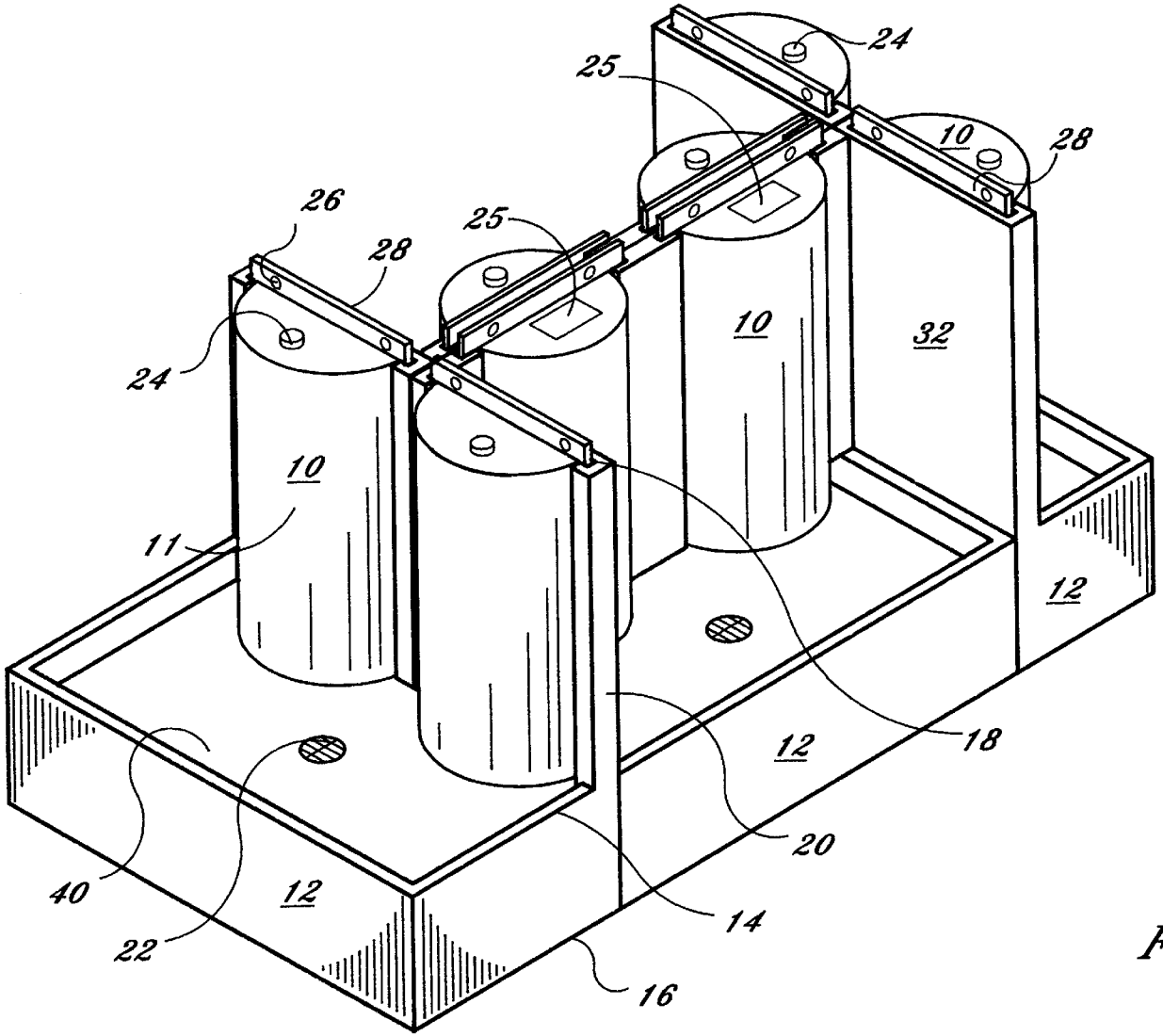
FIG. 1 is a perspective view of a first embodiment of the present invention.
Figure 2:
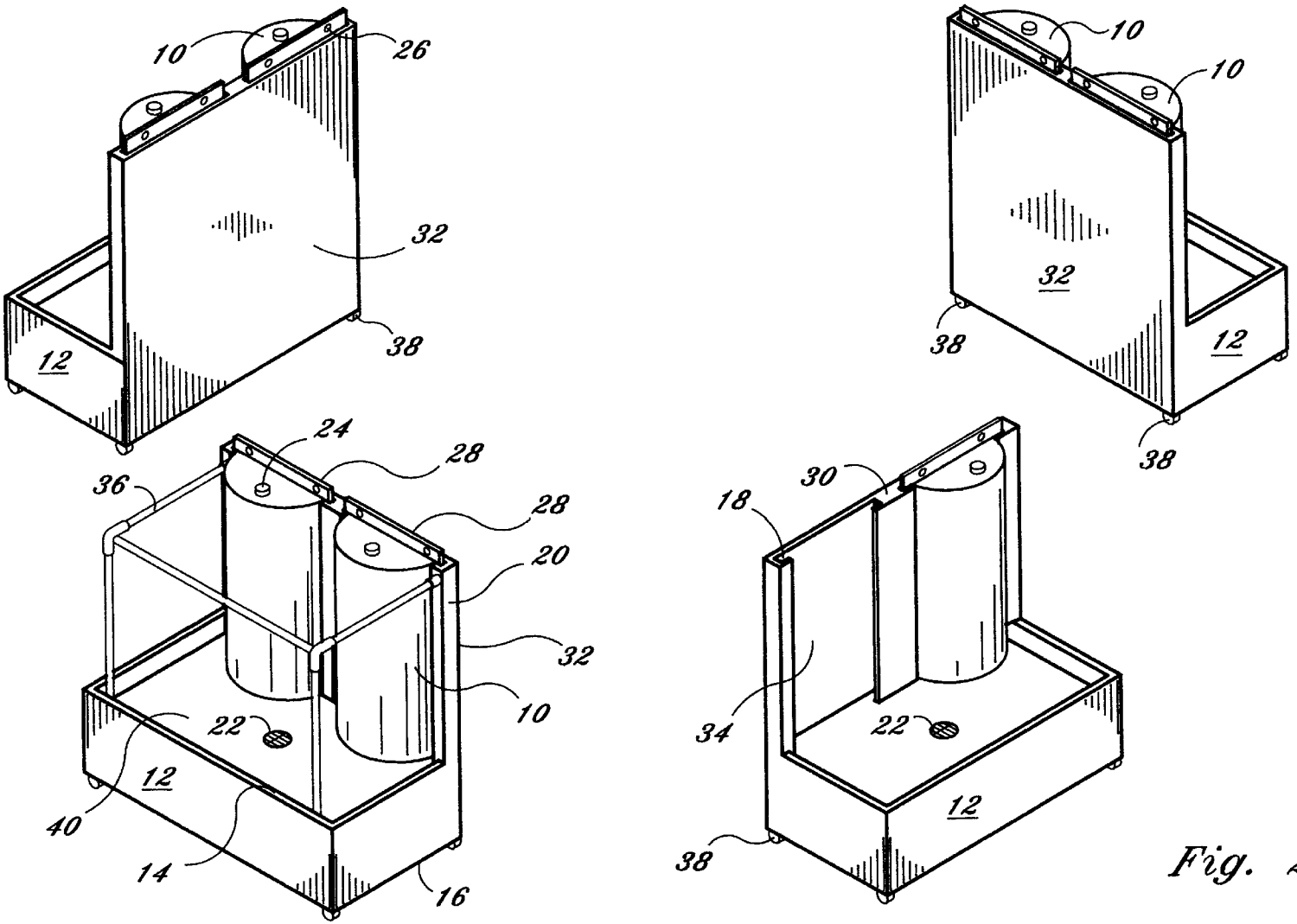
FIG. 2 is a partial exploded perspective view of a first embodiment of the present invention.

Referring now to FIGS. 1 and 2, a first embodiment of the instant chemical waste collection and disposal system and apparatus is shown comprising a container 10 which can have a curved, arcuate, or semi-circular portion 11 and a planar portion 28. Two containers 10, of the size of approximately one-half of a fifty-five (55) gallon drum, fit upon a pallet 12. In one embodiment, four pallets can be combined in a unit for usage upon a cruise or other ship. In one embodiment, the container 10 is approximately 30 inches high, 18 inches across, 11 inches across and 11 inches wide, holding approximately twenty-four (24) gallons. These dimensions are given by way of a example and are not to be considered limiting. In this embodiment, two containers 10 are proportioned to fit, when placing planar portion 28 of a first container 10 to planar portion 28 of a second container 10, within a 55 gallon drum which is standard for chemical waste disposal.

Containers 10 can have any suitable means for filling such as opening 24 at its top into which a liquid chemical waste stream flows. Alternately, container 10 can have a larger opening such as trap door 25, to provide for the disposal of dry chemical wastes such as batteries. The planar portion 28 extends laterally and vertically from the body of the container 10. Planar portion 28 can extend across the uppermost portion of container 10 to provide a location for lifting. Alternately, a separate lifting means can be attached to container 10. The lifting means can be on the uppermost portion of container 10, and can include any suitable means for lifting, such as lifting eyes (not shown) or holes 26 which allow movement of container 18 into securement with pallet 12 and out of pallet 12 for transport and disposal.

The pallet 12 includes a lower edge 16 and an upper edge 14. The upper edge 14 exhibits a vertical structure or support 20 which extends upward from its periphery. The pallet 12, in one embodiment, is approximately 21.5 inches wide, 43 inches long, 44.75 inches high, and has an internal hollow volume 40 between the upper and lower edges thereof. Again, these dimensions are given by way of example and are not to be considered limiting. The vertical support 20 has a inward surface 34, facing the pallet 12 and container 10, and an outward surface 32 which rests against the other pallets 12 in one embodiment. The inward surface 34 has vertical engaging grooves 18 along its vertical periphery and in a suitably shaped extension 30 extending the vertical length of support 20.

Figure 3:
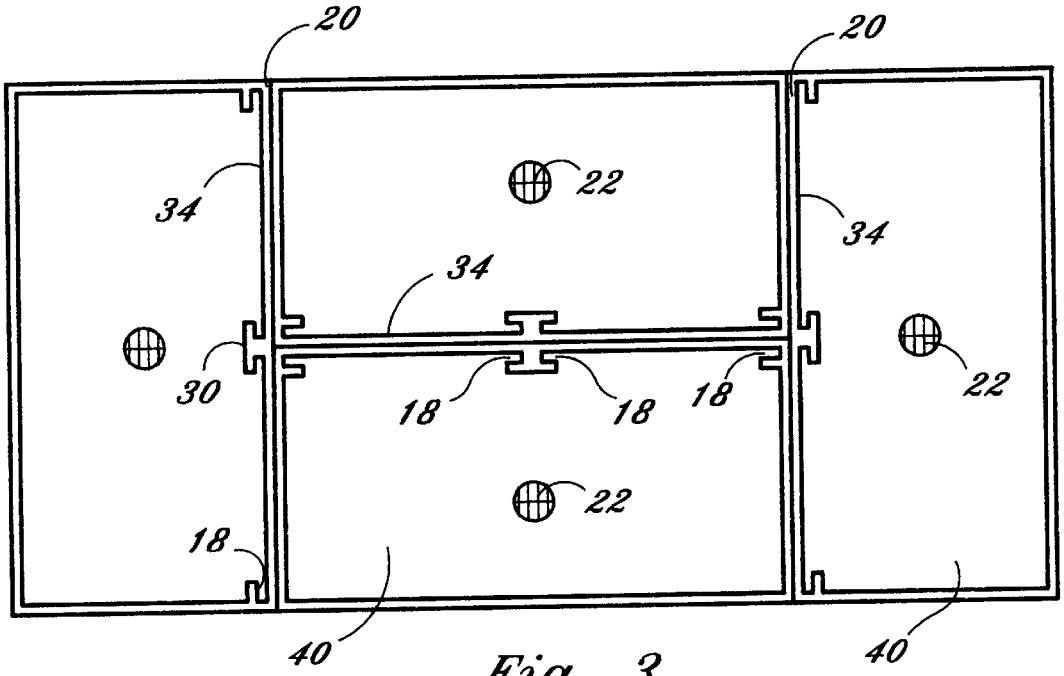
FIG. 3 is a top view of the pallets of the first embodiment of the present invention.

Planar portion 28 of container 10 slidably fits within grooves 18 in support 20 and extension 30. Grooves 18 can be seen best in FIG. 3, where an embodiment of four pallets is shown from above, without containers 10.

The container 10 can be maneuvered, by utilizing lifting holes 26 in the upper edge of planar portion 28 to vertically slide between each groove 18 in support 20 and extension 30 secure the container 10 to the pallet 12. In the embodiment shown in FIGS. 1–3, two containers 10 fit onto against surface 34 of support 20 of the pallet, and eight containers 10 can be stored.

As is illustrated in FIG. 1, pallet 12 can also have an opening 22 for collection of chemical waste, including overflow, spillage or leakage from the containers 10, into an internal hollow storage volume 40. In one embodiment, the internal hollow volume 40 can hold forty-eight (48) gallons of chemical waste, though this volume amount should not be considered limiting. The waste can be collected by a direct stream into the opening 22 of the pallet, or the opening can be used as a drain for any spillage or overflow arising from the waste flowing into the containers 10.

As is more particularly illustrated in FIG. 2, the pallet 12 may also include a guard rail 36 which keeps persons away from the open end 24 of the container 10 where the chemical stream is being collected. The pallet 12 may further include means for moving such as wheels 38 in a suitable location such as on its lower edge 16 to allow easy movement and portability of pallet 12.

In an alternate embodiment, each pallet 12 may be provided with an inclined surface to facilitate off loading of the containers 10 (not shown). In this embodiment, containers 10 can be secured to pallet 12 by means other than grooves 18, and containers 10 may not include means for lifting located near the uppermost portion.

The container 10 can be made from a chemically resistant plastic, such as polyethylene or other non-porous polymeric material. The container 10 may also be made of metal, but the metal container should include a phenolic liner to be non-corrosive to safely handle the chemical waste. The specifications for one embodiment of such a metal container can be as follows:

Material Carbon steel.

Gauge 11½" 0.125 backplate top and bottom 0.093 wrapped section.

Weld Heliarc welded 2800 degrees fahrenheit with Tec 129 filler rod.

Holes 9/16 holes for lifting.

Couplings 3" welded in steel coupling. ⅛" steel ¼ pipe tap for pressure testing.

Pressure Testing 10 psi for 15 minutes sustained, with soapy water on outside to detect leaks.

Weight Spec. 400 lbs.

Painting Spec. External: white enamel, rust inhibitor.

Internal: Phenicon, Epoxy Phenolic high solid.

However, it should be understood that other materials and specifications which will safely store and handle the waste and containments can be utilized and are considered within the scope of the invention.

Figure 5:
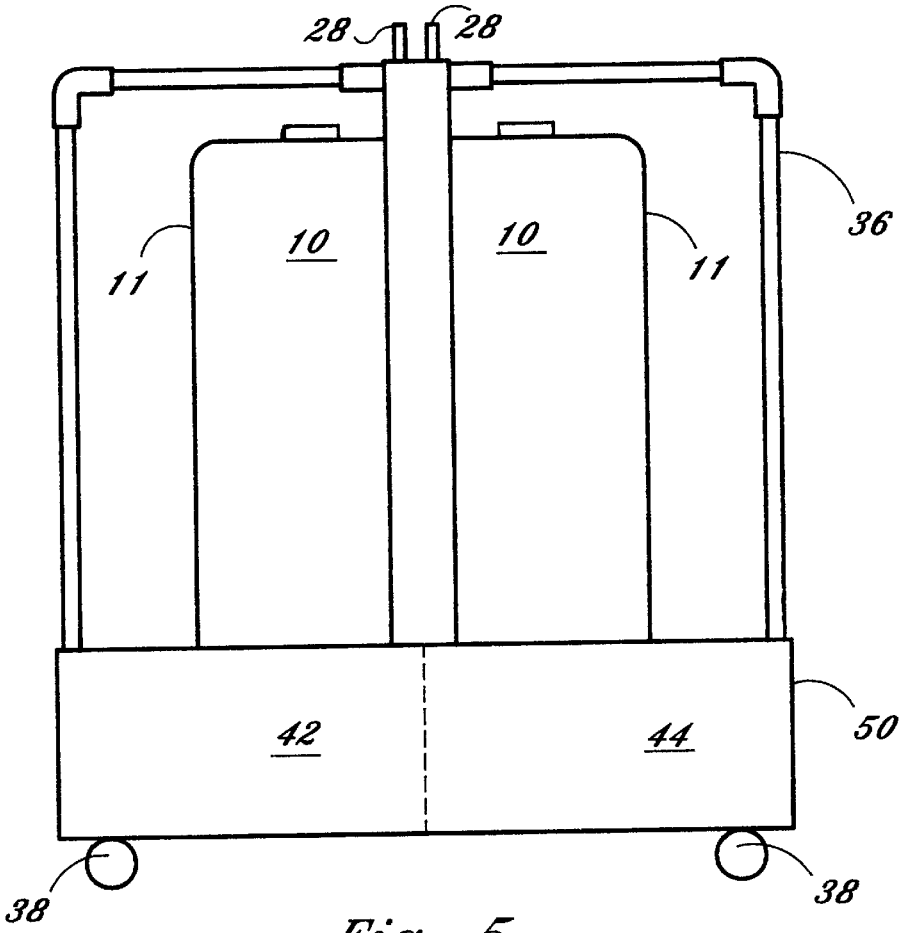
FIG. 5 is a side elevational view of the pallet of the second embodiment of the present invention.
Figure 4:
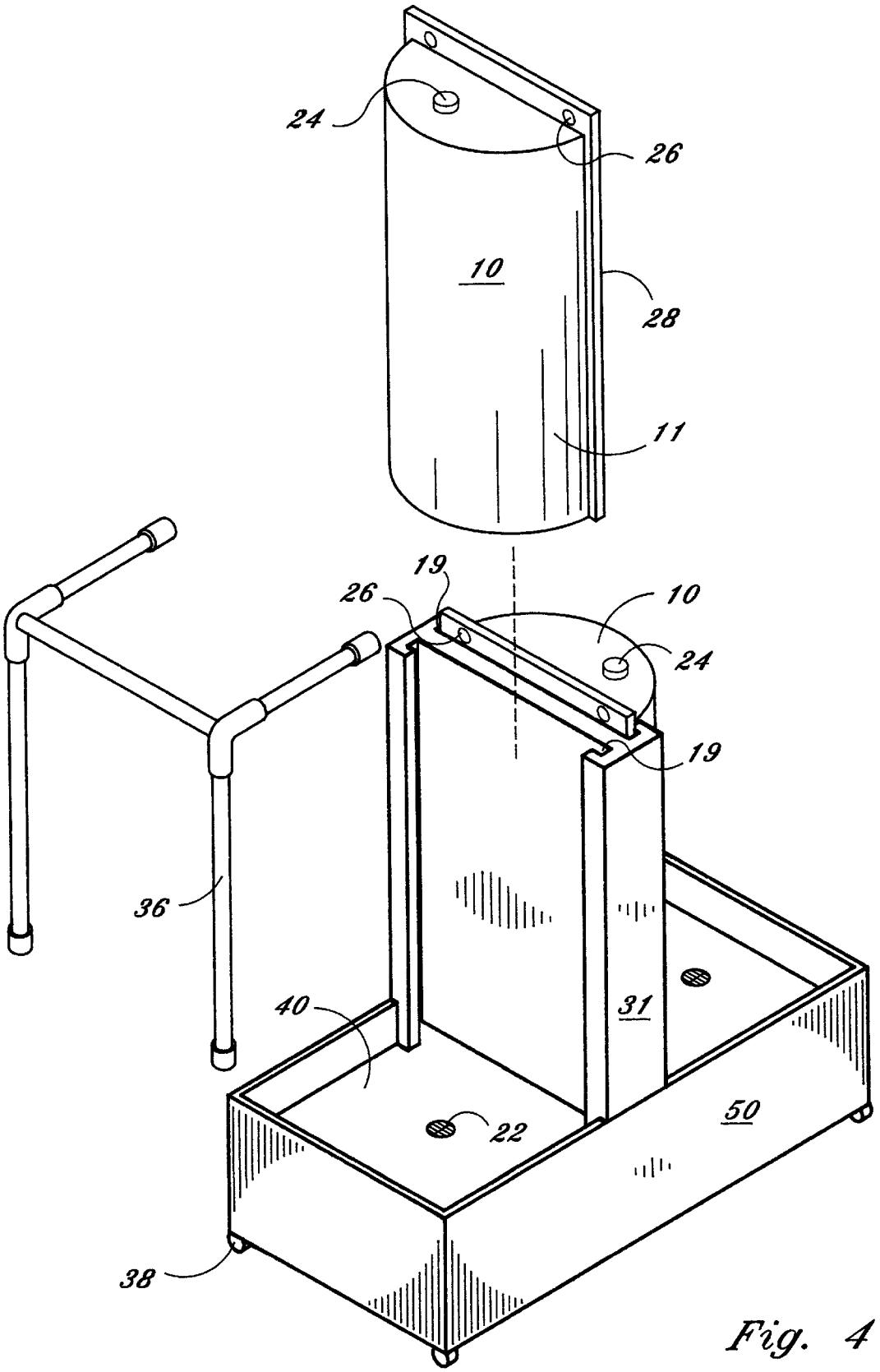
FIG. 4 is a partial exploded perspective view of a second embodiment of the present invention.

Referring now to FIGS. 4 and 5, a second, and preferred embodiment of the present invention is shown in which each container 10 may be slidably inserted into pallet 50, which is configured to hold two containers 10 of the size of approximately one-half of a fifty-five (55) gallon drum.

Pallet 50 is similar to pallet 12 of the first embodiment with the exception of the orientation of vertical support member 31 and grooves 19. Vertical support member 31 and grooves 19 engage the vertical edges of the planar portion 28 of each container 10 such that the planar portions 28 of each container 10 stored on pallet 50 are adjacent, or "back-to-back". This is in contrast to the first embodiment where each planar portion 28 of each of the two containers 10 stored per pallet are coplanar.

As may be seen in FIG. 5, the internal storage volume of pallet 50 can be divided into two storage divided into compartments 42 and 44. Thus two different types of chemical waste can be combined onto one pallet 50 without inadvertently mixing the overflow and contaminating different types of waste streams.

The above described embodiment of the present invention discloses the collection and storage containers 10 being sized approximately one-half the size of a fifty-five (55) gallon drum commonly used for chemical waste storage and transport. The embodiments described herein above are used as examples only to convey the essence of the invention. However, the invention is not intended to be limited to these embodiments but can be configured such that the collection and storage containers may be sized differently, and the pallets may hold any number of containers.

For example, containers sized to approximately one-third or one-fourth the size of a 55 gallon drum can be utilized, and still permit modular removal in 55 gallon drum sized units. In all embodiments, when transporting the waste for disposal or final destination, containers 10 are removed from their associated pallet and disposed within conventional fifty-five (55) gallon drums. Though fifty-five (55) gallon drums are commonly used, it should be understood that other size drums can be utilized and are considered within the scope of the invention.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A storage pallet for holding at least one chemical waste collection and disposal containers comprising:

a body member having an upper surface sized to receive at least one hollow chemical waste collection and storage container;

said body member including a support member extending vertically upward from said upper surface;

said support member including a first and a second retaining groove disposed on a first side of said support member;

said first and said second retaining grooves extending a majority of the vertical length of said support member;

said first and second retaining grooves positioned to face each other for engagement with a portion of a first hollow chemical waste collection and storage container.

2. The apparatus as claimed in claim 1 wherein said body member including a hollow base member having a preselected internal volume; said upper planar surface including means for filling said hollow base member with overflow or spillage of chemical waste from said at least one hollow chemical waste collection and storage container secured to said pallet member.

3. The apparatus as claimed in claim 1 wherein said storage pallet further includes a hand rail.

4. The apparatus as claimed in claim 1 wherein said storage pallet further includes means for portable movement connected to said body member.

5. The storage pallet of claim 1 wherein said support member further including a third and a fourth retaining groove, said third and fourth retaining grooves extending a majority of the vertical length of said support member, said third and fourth retaining grooves positioned to face each other for engagement with a portion of a second hollow chemical waste collection and storage container.

6. The storage pallet of claim 1 wherein said body member including a hollow base member having a preselected internal volume; said upper planar surface including a first means for filling a first portion of said hollow base member with any overflow or inadvertent spillage of chemical waste from the first hollow chemical waste collection and storage container engaged by said first and second retaining grooves, said upper planar surface including a second means for filling a second portion of said hollow base member with any overflow or inadvertent spillage of chemical waste from the second hollow chemical waste collection and storage container engaged by said third and fourth retaining grooves; wherein first portion of said hollow base member and said second portion of said hollow base member are independent of each other.

7. The storage pallet of claim 5 wherein said support member extending vertically upward from an intermediate portion of said upper surface; wherein said third and fourth retaining grooves are disposed on a second side of said support member.

8. A chemical waste collection and disposal apparatus comprising:

at least one hollow container having a first end and a second end, said first end and said second end connected together by at least one planar side member and at least one arcuate side member, said at least one hollow container sized to fit entirely within a 55 gallon drum;

said first end including means for filling said at least one hollow container with a chemical waste;

said at least one hollow container including a perimeter edge portion that extends a preselected distance outward of said at least one hollow container along an intersection of said at least one planar side member and said at least one arcuate side member;

a storage pallet comprising a hollow base member having a lower edge and an upper planar surface, said upper planar surface sized to receive said at least one hollow container;

said hollow base member including a support member, said support member extending vertically upward from said upper planar surface;

said support member including a first and a second retaining groove;

said first and said second retaining grooves extending vertically the length of said support member;

said first and second retaining grooves positioned to face each other for slidable engagement with said edge portion of said at least one hollow container;

said hollow base member having a preselected internal volume;

said upper planar surface including means for filling said hollow base member with overflow or spillage of chemical waste from said at least one hollow chemical waste collection and storage container secured to said pallet member.

9. The apparatus as claimed in claim 8 wherein said storage pallet further includes a hand rail.

10. The apparatus as claimed in claim 8 wherein said storage pallet further includes means for portable movement connected to said lower edge.

11. The apparatus as claimed in claim 8 wherein there are two hollow storage containers each having one planar side member and one arcuate side member, said hollow storage containers sized to fit within a 55 gallon drum with planar side members adjacent each other.

* * * * *